US010596576B2

(12) United States Patent
Rust et al.

(10) Patent No.: US 10,596,576 B2
(45) Date of Patent: Mar. 24, 2020

(54) APPARATUS AND METHOD FOR AN APRON ASSEMBLY

(71) Applicants: Joe Rust, Yankton, SD (US); Joseph Hammond, Yankton, SD (US); Jeff Schnabel, Volin, SD (US)

(72) Inventors: Joe Rust, Yankton, SD (US); Joseph Hammond, Yankton, SD (US); Jeff Schnabel, Volin, SD (US)

(73) Assignee: Kolberg-Pioneer, Inc., Yankton, SD (US)

( * ) Notice: Subject to any disclaimer, the term of this patent is extended or adjusted under 35 U.S.C. 154(b) by 1004 days.

(21) Appl. No.: 15/047,225

(22) Filed: Feb. 18, 2016

(65) Prior Publication Data

US 2016/0243553 A1 Aug. 25, 2016

Related U.S. Application Data

(60) Provisional application No. 62/117,594, filed on Feb. 18, 2015.

(51) Int. Cl.
*B02C 13/00* (2006.01)
*B02C 13/09* (2006.01)

(52) U.S. Cl.
CPC ..... *B02C 13/095* (2013.01); *B02C 13/00* (2013.01); *B02C 13/09* (2013.01)

(58) Field of Classification Search
CPC ..... B02C 13/09; B02C 13/095; B02C 13/31; B02C 13/185
USPC ..... 241/189.1, 192, 286, 289
See application file for complete search history.

(56) References Cited

U.S. PATENT DOCUMENTS 1,770,382 A * 7/1930 Armstrong ..... B02C 13/31 241/32
1,772,321 A * 8/1930 Ossing ..... B02C 13/31 241/287
1,872,233 A * 8/1932 Borton ..... B02C 13/282 241/189.1
2,486,421 A * 11/1949 Kessler ..... B02C 13/09 241/189.1
3,260,468 A * 7/1966 Beard ..... B02C 13/00 241/188.1

(Continued)

*Primary Examiner* — Teresa M Ekiert
*Assistant Examiner* — Smith Oberto Bapthelus
(74) *Attorney, Agent, or Firm* — Chambliss, Bahner & Stophel, P.C.

(57) ABSTRACT

An apron assembly comprising an apron mounted to the crusher and adapted to be moved between an operating position and an open position, a tension rod operatively attached to and disposed between the shock absorber mount and the apron, a spring seat mounted to the crusher and adapted to be moved between a raised position and a lowered position, a spring operatively disposed between the tension rod base and the spring seat, an actuator mounted to the crusher and the spring seat and adapted to be moved between a retracted position and an extended position, a shock absorber operatively attached to and disposed between the spring seat and a shock absorber mount. The shock absorber reduces the pressure applied to the actuator. A method for controlling the opening in a crusher comprising providing an apron assembly and moving the shock absorber between a retracted position and an extended position.

20 Claims, 12 Drawing Sheets

(56) References Cited

U.S. PATENT DOCUMENTS 3,850,375 A * 11/1974 Ford ..... B02C 13/095 241/101.75
3,857,519 A * 12/1974 Schafer ..... B02C 13/282 241/185.5
4,017,035 A * 4/1977 Stuttmann ..... B02C 13/095 241/189.1
4,330,091 A * 5/1982 Rozeboom ..... A01D 90/12 241/101.76
4,533,088 A * 8/1985 Lyston ..... B02C 4/12 241/186.3
4,558,826 A * 12/1985 Martinek ..... B02C 13/28 241/189.1
5,226,604 A * 7/1993 Seiffert ..... B02C 13/095 241/189.1
5,255,869 A * 10/1993 Smith ..... B02C 13/095 241/189.1
5,323,974 A * 6/1994 Watajima ..... B02C 13/1814 241/275
5,435,050 A * 7/1995 Alt ..... B02C 13/095 241/189.1
5,490,636 A * 2/1996 Schrodl ..... B02C 13/095 241/189.1
5,503,339 A * 4/1996 Doppstadt ..... B02C 13/04 241/166
5,513,811 A * 5/1996 Phan Hung ..... B02C 13/095 241/189.1
6,932,289 B2 * 8/2005 Musil ..... B02C 1/025 241/264
7,229,041 B2 * 6/2007 Cohen ..... B02C 13/09 241/189.1
8,668,158 B2 * 3/2014 Dallimore ..... B02C 25/00 241/189.1
8,960,577 B2 * 2/2015 Tjell ..... B02C 1/02 241/30
8,967,504 B2 * 3/2015 Dallimore ..... B02C 25/00 241/27
9,289,771 B2 * 3/2016 Faure ..... B02C 13/095
9,295,991 B2 * 3/2016 Hartl ..... B02C 1/025
9,849,459 B2 * 12/2017 Faure ..... B02C 13/095
2006/0086850 A1 * 4/2006 Cohen ..... B02C 13/09 241/189.1
2009/0140089 A1 * 6/2009 Boast ..... B02C 13/095 241/189.1
2011/0253821 A1 * 10/2011 Dallimore ..... B02C 13/095 241/189.1
2011/0253822 A1 * 10/2011 Dallimore ..... B02C 25/00 241/189.1
2013/0146692 A1 * 6/2013 Dallimore ..... B02C 25/00 241/27
2013/0284839 A1 * 10/2013 Faure ..... B02C 13/095 241/189.1
2014/0151482 A1 * 6/2014 Solomon ..... B02C 13/095 241/286
2015/0298132 A1 * 10/2015 Faure ..... B02C 13/282 241/189.1
2016/0243553 A1 * 8/2016 Rust ..... B02C 13/095

* cited by examiner

APPARATUS AND METHOD FOR AN APRON ASSEMBLY

CROSS-REFERENCES TO RELATED APPLICATIONS/PATENTS

This application relates back to and claims the benefit of priority from U.S. Provisional Application for Patent Ser. No. 62/117,594 titled "Shock Absorber for Crusher" and filed on Feb. 18, 2015.

FIELD OF THE INVENTION

The present invention relates generally to apron assemblies for rock crushers, and particularly to an apparatus and method for an apron assembly equipped with a shock absorber.

BACKGROUND AND DESCRIPTION OF THE PRIOR ART

It is known to use an apron assembly to control the size of the opening between the apron and rotary of a crusher and thereby control the size of the crushed material passing through the crusher. Conventional apron assemblies and methods, however, suffer from one or more disadvantages. For example, some conventional apron assemblies and methods use a manual bolt and shim combination. These conventional assemblies are labor-intensive and time-consuming. Other conventional apron assemblies and methods apply undesirably excessive forces to components of the apron assembly including the actuators. This is particularly so when uncrushable material enters a crusher and a "tramp iron" event takes place. As a result, conventional assemblies are expensive to maintain and repair and result in an undesirable amount of down-time or crusher inoperability. In addition, the components of conventional assemblies, including the actuators, have undesirably short lifespans.

It would be desirable, therefore, if an apparatus and method for an apron assembly could be provided that would not be labor-intensive or time-consuming. It would also be desirable if such an apparatus and method for an apron assembly could be provided that would be inexpensive to maintain and repair and not result in undesirable down-time or crusher inoperability. It would also be desirable if such an apparatus and method for an apron assembly could be provided that would increase the lifespan of the components of the assembly.

Advantages of the Preferred Embodiments of the Invention

Accordingly, it is an advantage of the preferred embodiments of the invention claimed herein to provide an apparatus and method for an apron assembly that is not labor-intensive or time-consuming. It is also an advantage of the preferred embodiments of the invention claimed herein to provide an apparatus and method for an apron assembly that is inexpensive to maintain and repair and does not result in undesirable down-time or crusher inoperability. It is a further advantage of the preferred embodiments of the invention claimed herein to provide an apparatus and method for an apron assembly that increases the lifespan of the components of the assembly.

Additional advantages of the preferred embodiments of the invention will become apparent from an examination of the drawings and the ensuing description.

EXPLANATION OF THE TECHNICAL TERMS

As used herein, the term "actuator" means shall mean any device, mechanism, assembly or combination thereof that is adapted to move or be moved between a retracted position and an extended position so as to impart a mechanical force. The term "actuator" shall include without limitation linear actuators, rotary actuators, hydraulic cylinders, hydraulic rotary actuators, pneumatic cylinders, springs and the like.

SUMMARY OF THE INVENTION

The apparatus of the invention comprises an apron assembly adapted for use on a crusher. The preferred apron assembly comprises an apron that is mounted to the crusher and is adapted to be moved between an operating position and an open position, a tension rod that is operatively attached to and disposed between a shock absorber mount and the apron and having a tension rod base, a spring seat that is mounted to the crusher and is adapted to be moved between a raised position and a lowered position, a spring that is operatively disposed between the tension rod base and the spring seat, an actuator that is mounted to the crusher and the spring seat and is adapted to be moved between a retracted position and an extended position, and a shock absorber that is operatively attached to and disposed between the spring seat and a shock absorber mount. In the preferred embodiments of the apron assembly the shock absorber reduces the pressure applied to the actuator.

The method of the invention comprises a method for controlling the opening in a crusher. The preferred method comprises providing an apron assembly. The preferred apron assembly comprises an apron that is mounted to the crusher and is adapted to be moved between an operating position and an open position, a tension rod that is operatively attached to and disposed between a shock absorber mount and the apron and having a tension rod base, a spring seat that is mounted to the crusher and is adapted to be moved between a raised position and a lowered position, a spring that is operatively disposed between the tension rod base and the spring seat, an actuator that is mounted to the crusher and the spring seat and is adapted to be moved between a retracted position and an extended position, and a shock absorber that is operatively attached to and disposed between the spring seat and a shock absorber mount. In the preferred embodiments of the apron assembly the shock absorber reduces the pressure applied to the actuator. The preferred method further comprises moving the shock absorber between a retracted position and an extended position.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
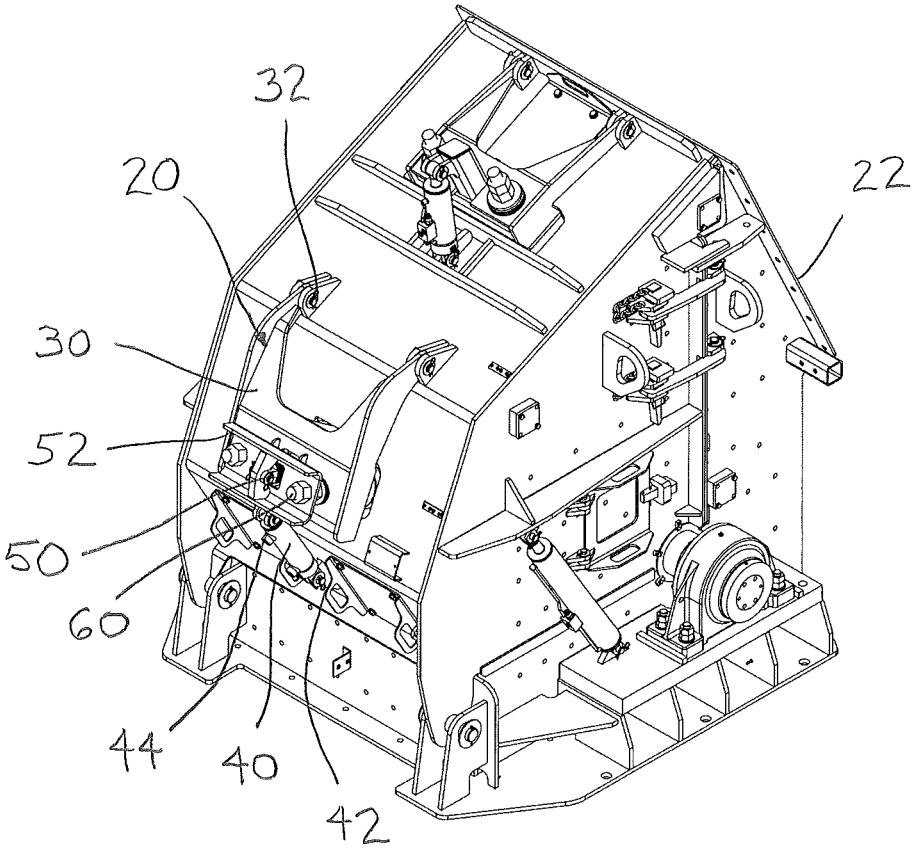
FIG. 1 is a front perspective view of the preferred embodiment of the apron assembly shown on an exemplary crusher in accordance with the present invention.

Referring now to the drawings, the preferred embodiments of the apparatus and method for an apron assembly in accordance with the present invention is illustrated by FIGS. 1 through 14.

As shown in FIGS. 1-14, the preferred embodiments of the invention are adapted to provide an apparatus and method for an apron assembly that is not labor-intensive or time-consuming. The preferred embodiments of the invention are also adapted to provide an apparatus and method for an apron assembly that is inexpensive to maintain and repair and does not result in undesirable down-time or crusher inoperability. In addition, the preferred embodiments of the invention are adapted to provide an apparatus and method for an apron assembly that increases the lifespan of the components of the assembly.

Referring now to FIG. 1, a front perspective view of the preferred embodiment of the apron assembly shown on an exemplary crusher in accordance with the present invention is illustrated. As shown in FIG. 1, the preferred apron assembly is designated generally by reference numeral 20. Preferred apron assembly 20 is adapted for use on exemplary crusher 22, but it is contemplated within the scope of the invention that the apron assembly may be adapted for use on any other suitable item of equipment. Preferred apron assembly 20 comprises spring seat 30 which is mounted to crusher 22 and adapted to be moved between a raised position (see, e.g. FIGS. 13-14) and a lowered position (see, e.g. FIGS. 11-12). Preferably, spring seat 30 is pivotally mounted to crusher 22 with a means for mounting the spring seat to the crusher such as spring seat pin 32, but it is contemplated within the scope of the invention that the spring seat may be mounted to the crusher with any suitable device, mechanism, assembly, or combination thereof such as a bolt, a rivet, and the like.

Still referring to FIG. 1, preferred apron assembly 20 also comprises an actuator such as hydraulic cylinder 40. The preferred actuator is mounted to crusher 22 and adapted to move between a retracted position (see, e.g. FIGS. 11-12) and an extended position (see, e.g. FIGS. 13-14). Preferably, the actuator is a linear actuator such as a hydraulic cylinder 40, but it is contemplated within the scope of the invention that the actuator may be any suitable device, mechanism, assembly, or combination thereof such as a pneumatic cylinder and the like. The preferred actuator is also pivotally mounted to crusher 22 with a means for mounting the actuator to the crusher such as first actuator pin 42, but it is contemplated within the scope of the invention that the actuator may be mounted to the crusher with any suitable device, mechanism, assembly, or combination thereof such as a bolt, rivet, and the like. The preferred actuator is also pivotally mounted to spring seat 30 with a means for mounting the actuator to the spring seat such as second actuator pin 44, but it is contemplated within the scope of the invention that the actuator may be mounted to the crusher with any suitable device, mechanism, assembly, or combination thereof such as a bolt, rivet, and the like.

Figure 6:
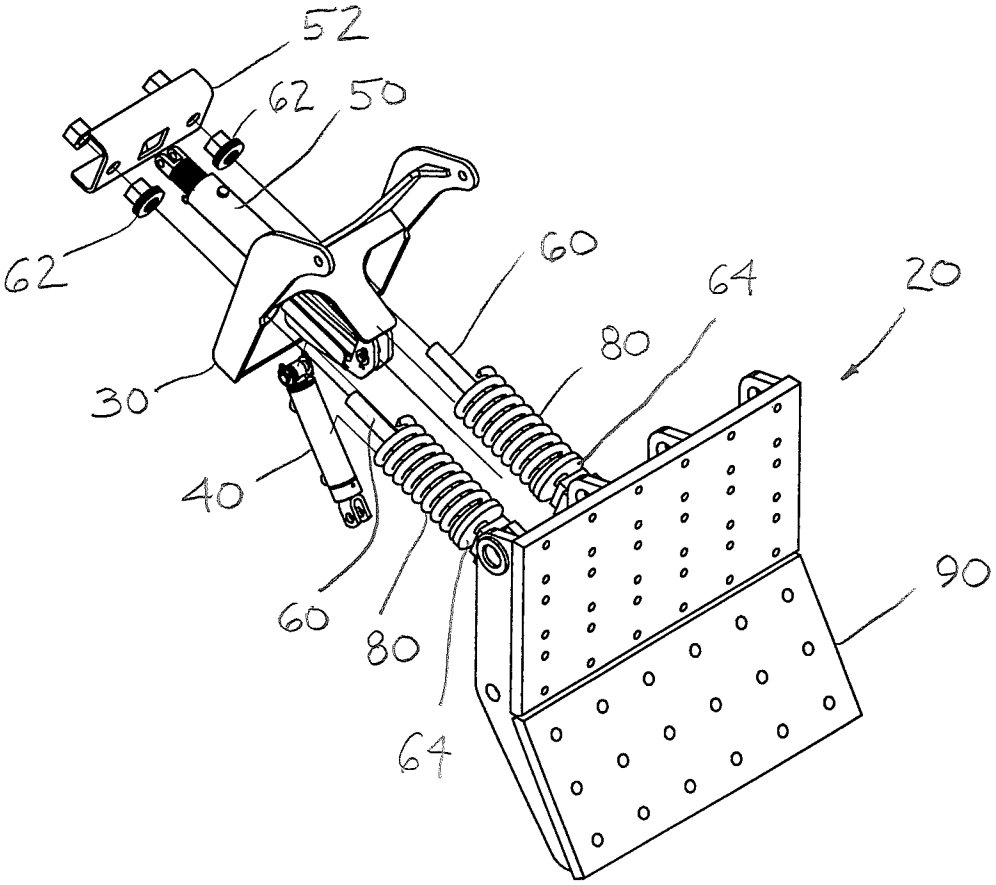
FIG. 6, a perspective exploded view of the preferred apron assembly illustrated in FIGS. 1-5.

Still referring to FIG. 1, preferred apron assembly 20 further comprises shock absorber 50 and shock absorber mount 52. Preferred shock absorber 50 is operatively attached to and disposed between preferred shock absorber mount 52 and preferred spring seat 30 (see, e.g. FIG. 9). Preferred shock absorber mount 52 is operatively attached to preferred shock absorber 50 and tension rod 60 (see, e.g. FIG. 9). Preferably, shock absorber 50 is a hydraulic shock absorber that controls the speed of the apron when the apron moves from the open position to the operating position. As shown in FIG. 6, preferred tension rods 60 are operatively attached to preferred apron 90. While FIG. 1 illustrates the preferred configuration and arrangement of the apron assembly, it is contemplated within the scope of the invention that the apron assembly may be of any suitable configuration and arrangement.

Figure 2:
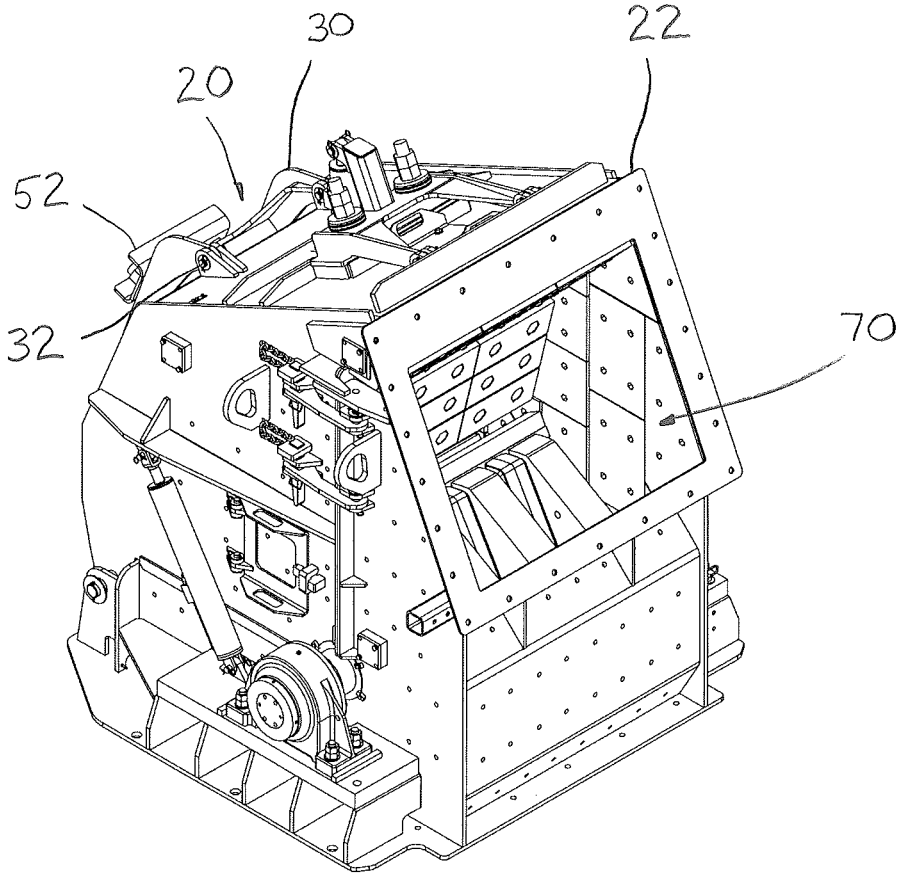
FIG. 2 is a back perspective view of the preferred apron assembly illustrated in FIG. 1.

Referring now to FIG. 2, a back perspective view of preferred apron assembly 20 is illustrated. As shown in FIG. 2, exemplary crusher 22 comprises material inlet 70 which is adapted to receive materials for crushing. Preferred apron assembly 20 comprises spring seat 30, spring seat pin 32, and shock absorber mount 52.

Figure 3:
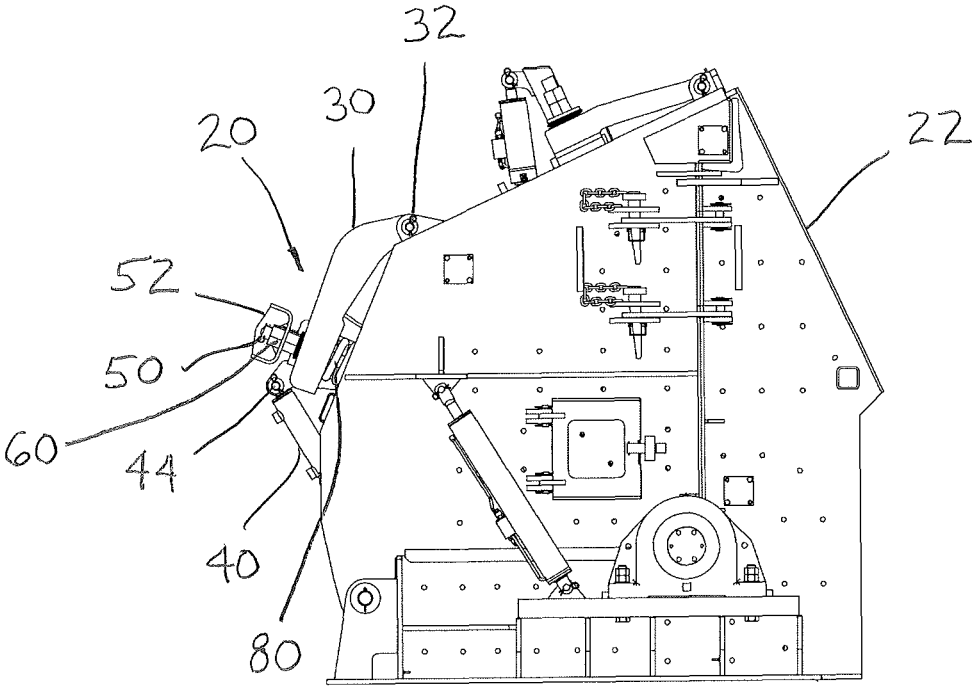
FIG. 3 is a right side view of the preferred apron assembly illustrated in FIGS. 1-2.

Referring now to FIG. 3, a right side view of preferred apron assembly 20 is illustrated. As shown in FIG. 3, preferred apron assembly 20 comprises spring seat 30, spring seat pin 32, actuator 40, actuator second pin 44, shock absorber 50, shock absorber mount 52, tension rod 60, and spring 80.

Figure 4:
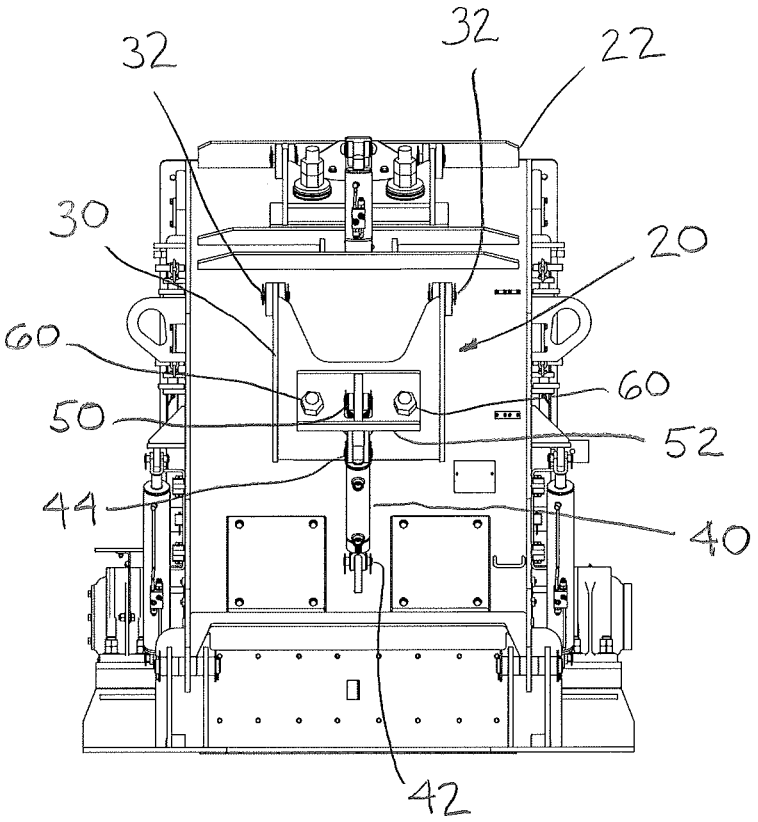
FIG. 4 is a front view of the preferred apron assembly illustrated in FIGS. 1-3.

Referring now to FIG. 4, a front view of preferred apron assembly 20 is illustrated. As shown in FIG. 4, preferred apron assembly 20 comprises spring seat 30, spring seat pins 32, actuator 40, actuator first pin 42, actuator second pin 44, shock absorber 50, shock absorber mount 52, and tension rods 60.

Figure 5:
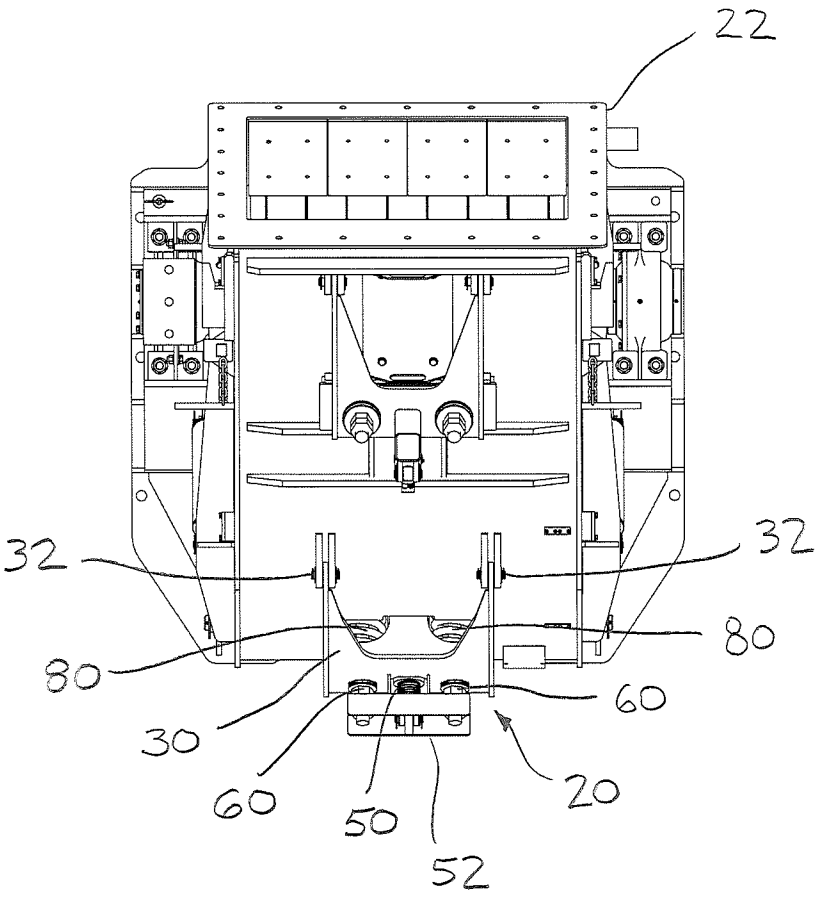
FIG. 5 is a top view of the preferred apron assembly illustrated in FIGS. 1-4.

Referring now to FIG. 5, a top view of preferred apron assembly 20 is illustrated. As shown in FIG. 5, preferred apron assembly 20 comprises spring seat 30, spring seat pins 32, shock absorber 50, shock absorber mount 52, and tension rods 60, and springs 80.

Figure 7:
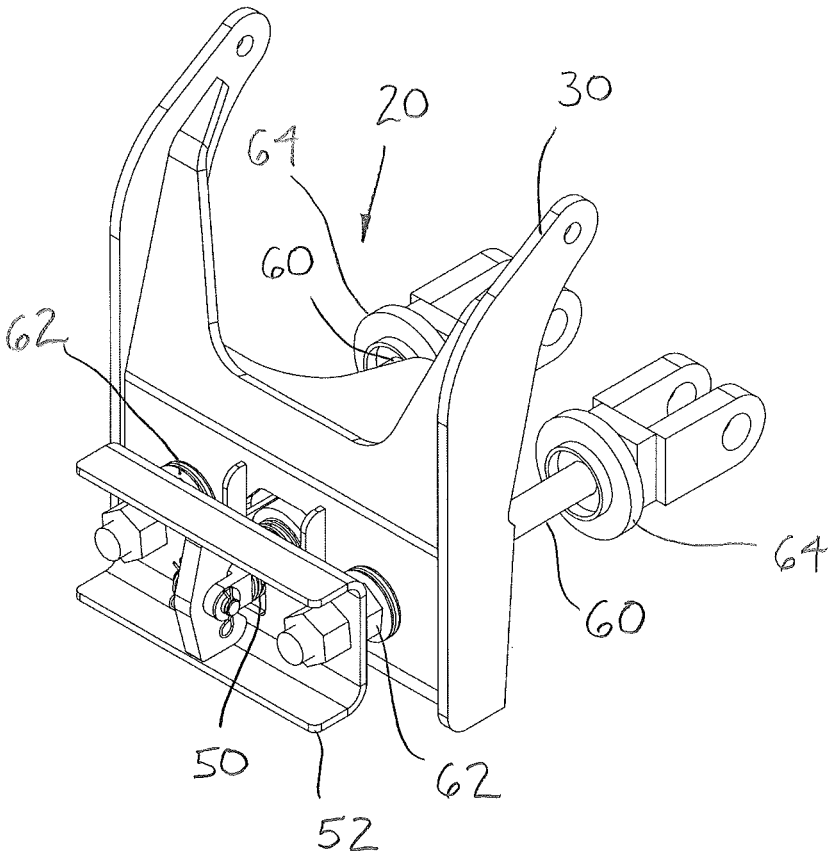
FIG. 7 is a front isolated perspective view of the preferred apron assembly illustrated in FIGS. 1-6.

Referring now to FIG. 6, a perspective exploded view of preferred apron assembly 20 is illustrated. As shown in FIG. 6, preferred apron assembly 20 comprises spring seat 30, actuator 40, shock absorber 50, shock absorber mount 52, tension rods 60, tension rod nuts 62, tension rod bases 64, springs 80, and apron 90. More particularly, springs 80 are disposed between tension rod bases 64 and spring seat 30, and tension rods 60 are operatively attached to and disposed between apron 90 and shock absorber mount 52. Preferably, springs 80 urge apron 90 into the operating position. While FIG. 6 illustrates the preferred configuration and arrangement of the apron assembly, it is contemplated within the scope of the invention that the apron assembly may be of any suitable configuration and arrangement, Referring now to FIG. 7, a front isolated perspective view of preferred apron assembly 20 is illustrated. As shown in FIG. 7, preferred apron assembly 20 comprises spring seat 30, shock absorber 50, shock absorber mount 52, tension rods 60, tension rod nuts 62, and tension rod bases 64.

Figure 8:
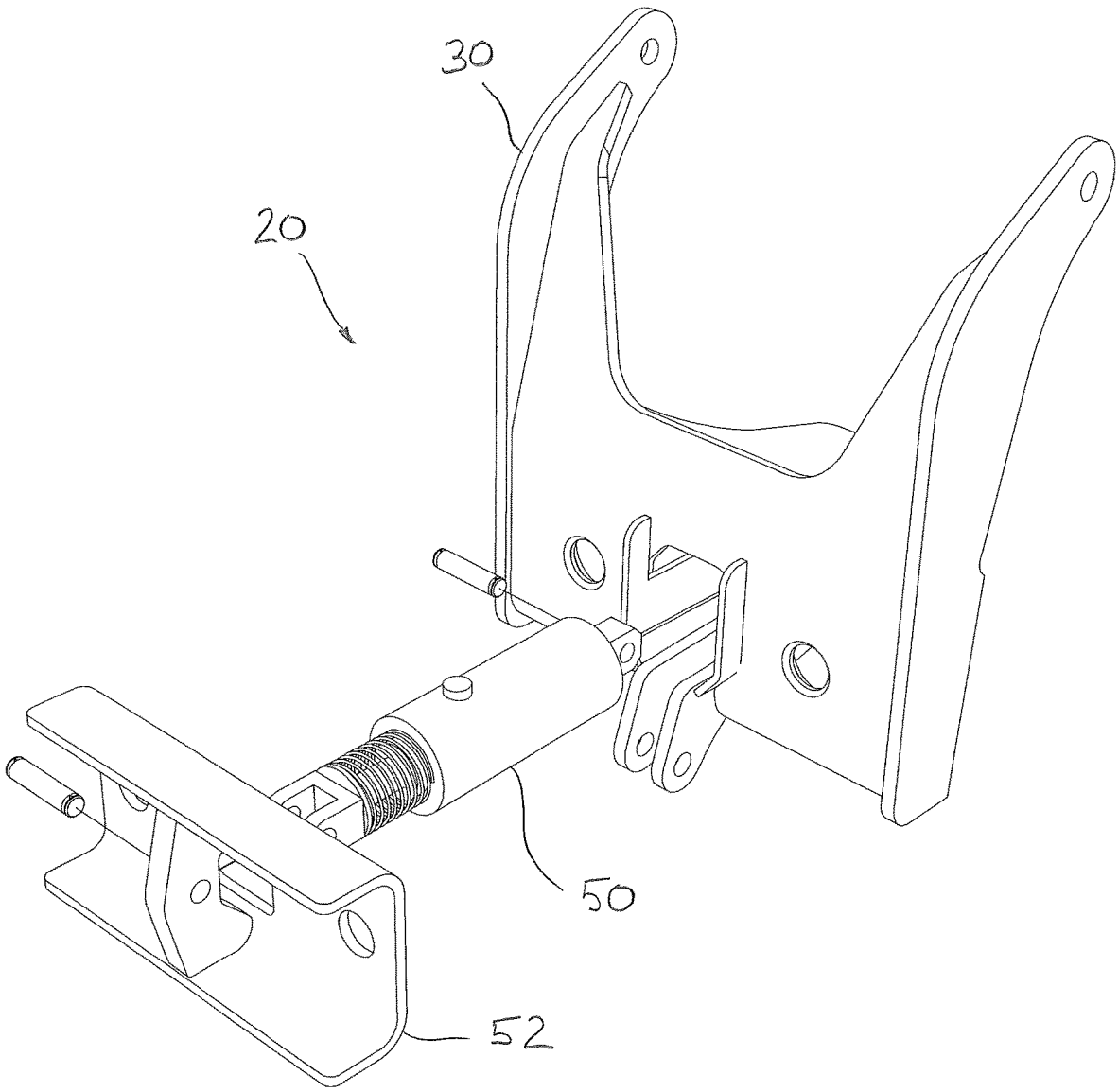
FIG. 8 is a front isolated exploded perspective view of the preferred apron assembly illustrated in FIGS. 1-7.

Referring now to FIG. 8, a front isolated exploded perspective view of preferred apron assembly 20 is illustrated. As shown in FIG. 8, preferred apron assembly 20 comprises spring seat 30, shock absorber 50, and shock absorber mount 52.

Figure 9:
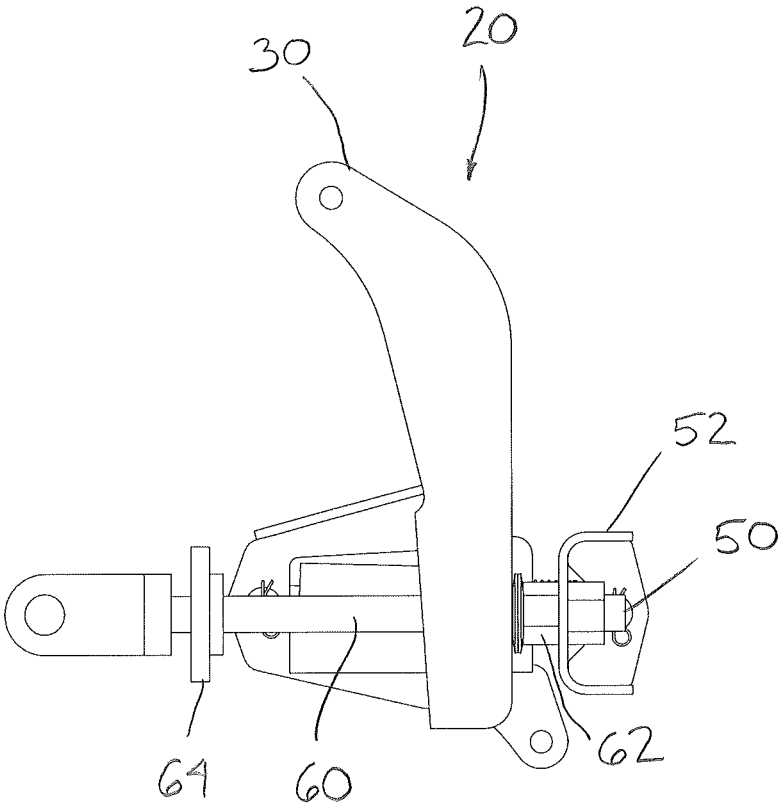
FIG. 9 is a left side isolated view of the preferred apron assembly illustrated in FIGS. 1-8.

Referring now to FIG. 9, a left side isolated view of preferred apron assembly 20 is illustrated. As shown in FIG. 9, preferred apron assembly 20 comprises spring seat 30, shock absorber 50, shock absorber mount 52, tension rod 60, tension rod nut 62, and tension rod base 64.

Figure 10:
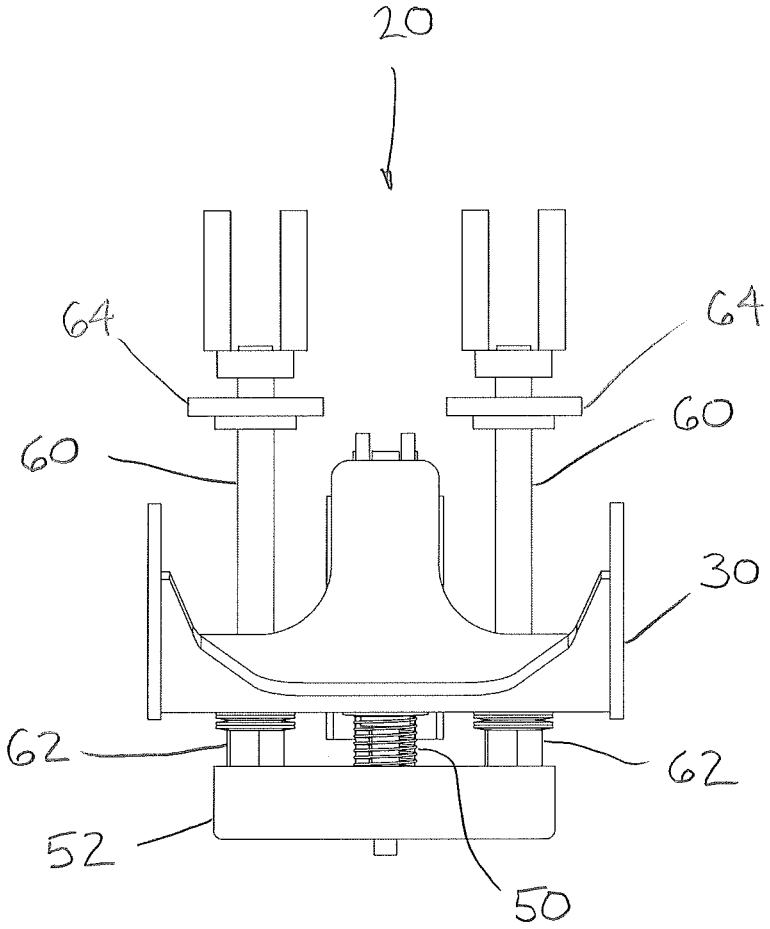
FIG. 10 is a top isolated view of the preferred apron assembly illustrated in FIGS. 1-9.

Referring now to FIG. 10, a top isolated view of preferred apron assembly 20 is illustrated. As shown in FIG. 10, preferred apron assembly 20 comprises spring seat 30, shock absorber 50, shock absorber mount 52, tension rods 60, tension rod nuts 62, and tension rod bases 64.

Figure 11:
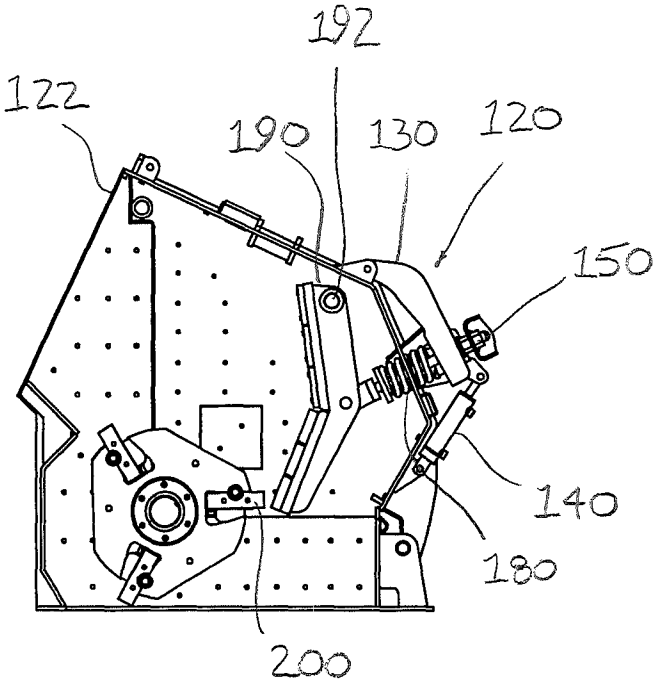
FIG. 11 is a partial sectional left side view of a first alternative embodiment of the apron assembly shown on an exemplary crusher in accordance with the present invention.

Referring now to FIG. 11, a partial sectional left side view of a first alternative embodiment of the apron assembly shown on an exemplary crusher is illustrated. As shown in FIG. 11, the first alternative embodiment of the apron assembly is designated generally by reference numeral 120 and exemplary crusher is designated by reference numeral 122. Preferred spring seat 130 is in a lowered position, preferred actuator 140 is in a retracted position, preferred shock absorber 150 is in a retracted position and preferred springs 180 are in an extended position, and preferred apron 190 is in an operating position. More particularly, preferred apron 190 is pivotally mounted to crusher 122 with a means for mounting the apron to the crusher such as apron pin 192. As a result, preferred apron 190 is adapted to be moved between an operating position (closed) and an open position (overload). Further, preferred apron 190 is positioned between 1-3 inches from the distal end of the rotary blow bar 200, preferred springs 180 are compressed 2 inches, preferred actuator 140 is positioned to the desired closed side setting, and preferred shock absorber 150 is collapsed. With preferred apron assembly 120 in this configuration, crusher 122 is adapted to produce relatively small-sized product, and preferred apron 190 will further compress preferred springs 180 based upon the amount and size of the material passing through the crusher. When the load in crusher 122 reduces, preferred springs 180 rapidly push apron 190 back to its initial position, and pressure in the base end of preferred actuator 140 spikes. Preferred shock absorber 150 reduces the speed at which apron 190 returns to its initial position and reduces the pressure applied to the base end of preferred actuator 140.

Figure 12:
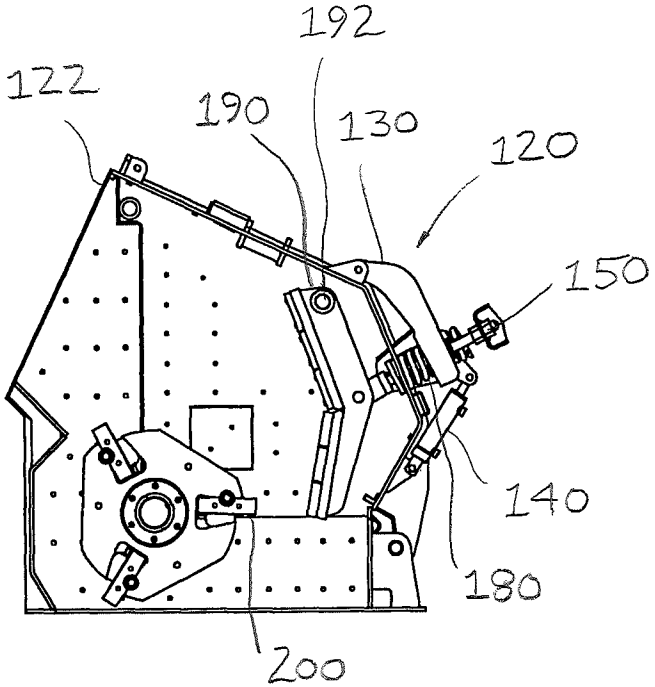
FIG. 12 is a partial sectional left side view of the first alternative embodiment of the apron assembly illustrated in FIG. 11.

Referring now to FIG. 12, a partial sectional left side view of preferred apron assembly 120 is illustrated. As shown in FIG. 12, preferred spring seat 130 is in a lowered position, preferred actuator is in a retracted position, preferred shock absorber 150 is in an extended position, preferred springs 180 are in a compressed position, and preferred apron 190 is in an open position. More particularly, preferred actuator 140 is positioned to the desired closed side setting, preferred shock absorber 150 is extended, preferred springs 180 are compressed 6 inches, and preferred apron 190 is in an open position. With preferred apron assembly 120 in this configuration, crusher 122 is adapted to allow a large load or uncrushable to pass through without damaging the crusher components. Because the tip speed of rotary blow bar 200 can be in the range of 6,000 feet per minute, preferred apron 190 moves to an open position very rapidly when a large rock or uncrushable enters the crusher. As a result, the pressure in the rod side of preferred actuator 140 can spike rapidly, and the preferred shock absorber 150 moves from a retracted position to an extended position. When the pressure remains below 2,000 psi on the rod side of preferred actuator 140, the preferred apron 190 will return to the desired operating position at a rate controlled by the preferred shock absorber 150 once the overload clears.

Figure 13:
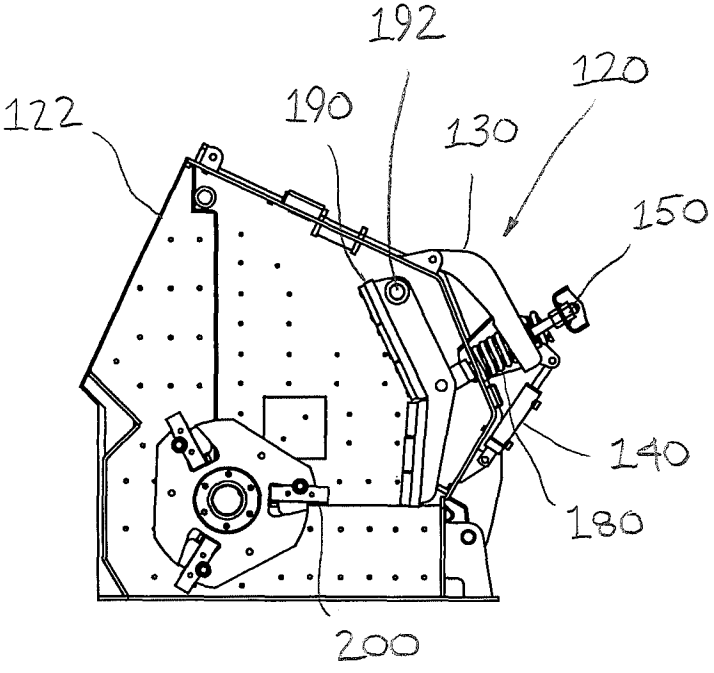
FIG. 13 is a partial sectional left side view of the first alternative embodiment of the apron assembly illustrated in FIGS. 10-12.

Referring now to FIG. 13, a partial sectional left side view of preferred apron assembly 120 is illustrated. As shown in FIG. 13, preferred spring seat 130 is in a raised position, preferred actuator 140 is in an extended position, preferred shock absorber 150 is in an extended position, preferred springs 180 are in a compressed position, and preferred apron 190 is in an open position, More particularly, preferred springs 180 are compressed more than 6 inches. With preferred apron assembly 120 in this configuration, crusher 122 is adapted to allow a large load or an uncrushable to pass without damaging the components of the crusher. If the pressure in the rod side of preferred actuator 140 exceeds a pre-determined setting (e.g. 2,000 psi), then sequence valves convey fluid from the rod side to the base side of preferred actuator 140, and the actuator rod extends.

Figure 14:
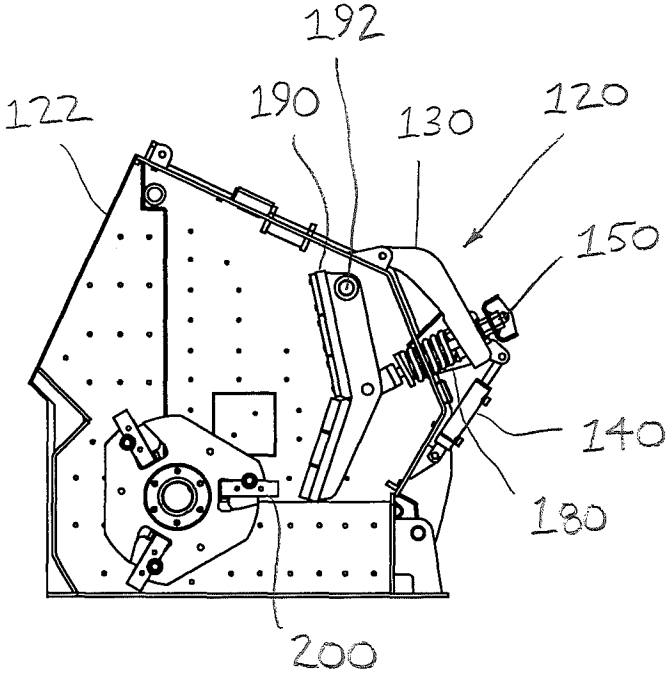
FIG. 14 is a partial sectional left side view of the first alternative embodiment of the apron assembly illustrated in FIG. 10-13.

Referring now to FIG. 14, a partial sectional side view of preferred apron assembly 120 is illustrated. As shown in FIG. 14, preferred spring seat 130 is in a raised position, preferred actuator is in an extended position, preferred shock absorber 150 is in a retracted position, preferred springs 180 are in an extended position, and preferred apron 190 is in an operating position. More particularly, preferred springs 180 have returned to their initial 2 inch compression. This is the disposition of preferred apron assembly 120 after a large load or an uncrushable has passed through the crusher. With preferred apron assembly 120 in this configuration, preferred apron 190 is farther away from rotary blow bar 200 than the initial setting. This is an indication to the operator that crusher 122 was overloaded or an uncrushable went through it. In order to return preferred apron 190 to its initial setting, preferred actuator 140 must be adjusted.

The invention also comprises a method for controlling the opening in a crusher. The preferred method comprises providing an apron assembly. The preferred apron assembly comprises an apron that is mounted to the crusher and is adapted to be moved between an operating position and an open position, a spring seat that is mounted to the crusher and is adapted to be moved between a raised position and a lowered position, a spring that is operatively disposed between the tension rod base and the spring seat, an actuator that is mounted to the crusher and is adapted to move between a retracted position and an extended position, a shock absorber that is operatively attached to and disposed between the spring seat and a shock absorber mount, and a tension rod that is operatively attached to the apron and the shock absorber mount. In the preferred apron assembly, the shock absorber reduces the pressure applied to the actuator when the spring force moves the apron back to the operating position. The preferred method further comprises moving the shock absorber between a retracted position and an extended position.

In operation, several advantages of the preferred embodiments of the apron assembly are achieved. For example, the preferred embodiments of the apron assembly reduce the amount of pressure applied to the base end of the actuator when the crusher is operating under normal conditions.

More particularly, under normal conditions, the actuator is set in the desired position for crushing purposes so as to define the distance between the rotary blow bar and the tip of the apron. The actuator holds the apron at the required setting to produce a desired product size. The apron moves between an inward position and an outward position during crushing operations as rocks impact against the apron. As the apron moves from the inward position to the outward position, force is applied to the springs which compress. At the same time, as the apron moves from the inward position to the outward position, the tension rods apply a force to the shock absorber mount which in turn extends the shock absorber. When the load applied to the apron decreases, the apron moves from the outward position to the inward position and the nut of the tension rods impacts the spring seat which in turn exerts a compressive force on the actuator, thereby increasing the pressure in the base end of the actuator. At the same time, as the apron moves from the outward position to the inward position, the tension rods apply a compressive force on the shock absorber mount which in turn retracts the shock absorber which controls the speed of the movement and reduces the amount of pressure in the base end of the actuator.

In addition, the preferred embodiments of the apron assembly reduce the amount of pressure applied to the actuator following an overload or uncrushable event. More particularly, after a large load or an uncrushable passes through the crusher, the springs move from a compressed position to an extended position and the apron moves from an open position to an operating position. More particularly, when a large rock or uncrushable object hits the apron, the apron moves from a closed position to an open position, the tension rods exert an outward force on the shock absorber mount, the shock absorber mount extends the shock absorber, and the springs compress and the shock absorber extends, thereby increasing the pressure in the rod side of the actuator. If the pressure in the rod end of the actuator exceeds a pre-determined limit (e.g. 2,000 psi), valves will relieve the pressure and the actuator rod will extend, thereby moving the apron to the open position and allowing the oversized rock or uncrushable object to pass through the large opening between the rotary blow bar and the apron. After the oversized rock or uncrushable object passes through the opening between the rotary and the apron, the springs extend back to their operating position, i.e. the extended position. During the extension of the springs, the extended shock absorber controls the speed at which the apron moves from the open position to the operating position. More particularly, the shock absorber reduces the speed at which the apron moves from the open position to the operating position so as to reduce the force exerted by the tension bar nuts on the spring seat and prevent excessive pressure in the base end of the actuator when the apron returns to its initial position relative to the spring seat.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. An apron assembly adapted for use on a crusher, said apron assembly comprising:

(a) an apron, said apron being mounted to the crusher and being configured to be moved between an operating position and an open position;

(b) a tension rod, said tension rod being operatively attached to and disposed between the apron and a shock absorber mount and said tension rod having a tension rod base;

(c) a spring seat, said spring seat being mounted to the crusher and being configured to be moved between a raised position and a lowered position;

(d) a spring, said spring being operatively disposed between the tension rod base and the spring seat;

(e) an actuator, said actuator being mounted to the crusher and the spring seat and being configured to be moved between a retracted position and an extended position;

(f) a hydraulic shock absorber, said hydraulic shock absorber being operatively attached to and disposed between the spring seat and the shock absorber mount;

wherein the hydraulic shock absorber reduces the pressure applied to the actuator when the crusher is operating under normal crushing conditions and during a tramp iron event; and wherein the hydraulic shock absorber reduces the speed at which the apron returns from the open position to the operating position after a tramp iron event.

2. The apron assembly of claim 1 wherein the apron is pivotally mounted to the crusher.

3. The apron assembly of claim 1 wherein the spring seat is pivotally mounted to the crusher.

4. The apron assembly of claim 1 wherein the spring urges the apron into the operating position.

5. The apron assembly of claim 1 wherein the actuator comprises a linear actuator.

6. The apron assembly of claim 1 wherein the actuator comprises a hydraulic cylinder.

7. The apron assembly of claim 1 wherein the actuator is pivotally mounted to the crusher.

8. The apron assembly of claim 1 wherein the actuator is pivotally mounted to the spring seat.

9. The apron assembly of claim 1 wherein the shock absorber controls the speed of the spring seat as the spring seat moves between the raised position and the lowered position.

10. The apron assembly of claim 1 wherein the shock absorber comprises a hydraulic shock absorber.

11. The apron assembly of claim 1 further comprising a means for mounting the apron to the crusher.

12. The apron assembly of claim 11 wherein the means for mounting the apron to the crusher comprises an apron pin.

13. The apron assembly of claim 1 further comprising a means for mounting the spring seat to the crusher.

14. The apron assembly of claim 13 wherein the means for mounting the spring seat to the crusher comprises a spring seat pin.

15. The apron assembly of claim 1 further comprising a means for mounting the actuator to the crusher.

16. The apron assembly of claim 15 wherein the means for mounting the actuator to the crusher comprises a first actuator pin.

17. The apron assembly of claim 1 further comprising a means for mounting the actuator to the spring seat.

18. The apron assembly of claim 17 wherein the means for mounting the actuator to the spring seat comprises a second actuator pin.

19. An apron assembly adapted for use on a crusher, said apron assembly comprising:

(a) an apron, said apron being pivotally mounted to the crusher and being configured to be moved between an operating position and an open position;

(b) a tension rod, said tension rod being operatively attached to and disposed between the apron and a shock absorber mount and said tension rod having a tension rod base;

(c) a spring seat, said spring seat being pivotally mounted to the crusher and being configured to be moved between a raised position and a lowered position;

(d) a spring, said spring being operatively disposed between the tension rod base and the spring seat and being configured to urge the apron into the operating position;

(e) an actuator, said actuator being pivotally mounted to the crusher and the spring seat and being configured to be moved between a retracted position and an extended position;

(f) a hydraulic shock absorber, said hydraulic shock absorber being operatively attached to and disposed between the spring seat and the shock absorber mount;

wherein the hydraulic shock absorber reduces the speed of the apron when the spring urges the apron from the open position into the operating position after a tramp iron event; and wherein the hydraulic shock absorber reduces the pressure applied to the actuator when the crusher is operating under normal crushing conditions and during a tramp iron event.

20. A method for controlling the opening in a crusher, said method comprising:

(a) providing an apron assembly, said apron assembly comprising:

(1) an apron, said apron being mounted to the crusher and being configured to be moved between an operating position and an open position;

(2) a tension rod, said tension rod being operatively attached to and disposed between the apron and a shock absorber mount and said tension rod having a tension rod base;

(3) a spring seat, said spring seat being mounted to the crusher and being configured to be moved between a raised position and a lowered position;

(4) a spring, said spring being operatively disposed between the tension rod base and the spring seat;

(5) an actuator, said actuator being mounted to the crusher and the spring seat and being configured to be moved between a retracted position and an extended position;

(6) a hydraulic shock absorber, said hydraulic shock absorber being operatively attached to and disposed between the spring seat and the shock absorber mount;

wherein the hydraulic shock absorber reduces the pressure applied to the actuator when the crusher is operating under normal crushing conditions and during a tramp iron event; and wherein the hydraulic shock absorber reduces the speed at which the apron returns from the open position to the operating position after a tramp iron event;

(b) moving the hydraulic shock absorber between a retracted position and an extended position.

* * * * *